US007187330B2

(12) United States Patent
Powell et al.

(10) Patent No.: US 7,187,330 B2
(45) Date of Patent: Mar. 6, 2007

(54) DIFFERENTIAL AND SINGLE ENDED ELLIPTICAL ANTENNAS

(75) Inventors: Johnna Dawn Powell, Cambridge, MA (US); Anantha Chandrakasan, Belmont, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 11/158,905

(22) Filed: Jun. 22, 2005

(65) Prior Publication Data

US 2005/0280582 A1 Dec. 22, 2005

Related U.S. Application Data

(60) Provisional application No. 60/582,099, filed on Jun. 22, 2004.

(51) Int. Cl.
*H01Q 1/38* (2006.01)

(52) U.S. Cl. ..... 343/700 MS; 343/700 MS

(58) Field of Classification Search ..... 343/700 MS, 343/769

See application file for complete search history.

(56) References Cited

U.S. PATENT DOCUMENTS 4,063,246 A 12/1977 Greiser
5,565,875 A 10/1996 Buralli et al.
6,278,410 B1 * 8/2001 Soliman et al. ..... 343/769
6,603,429 B1 * 8/2003 Bancroft et al. ..... 343/700 MS
2002/0122010 A1 9/2002 McCorkie
2005/0248487 A1 * 11/2005 Okado ..... 343/700 MS

FOREIGN PATENT DOCUMENTS

WO WO 02/13313 A2 2/2002

OTHER PUBLICATIONS

PCT Search Report of the ISA for PCT/US2005/021796 dated Oct. 19, 2005.
Written Opinion of the ISA for PCT/US2005/021796 dated Oct. 19, 2005.

* cited by examiner

*Primary Examiner*—Hoang V. Nguyen
*Assistant Examiner*—Dieu Hien Duong
(74) *Attorney, Agent, or Firm*—Daly, Crowley, Mofford & Durkee, LLP

(57) ABSTRACT

An antenna element includes a radiating antenna element having an elliptical shape disposed on a first surface of a substrate. A dielectric clearance region having an elliptical shape is disposed about the radiating antenna element to space the radiating antenna element from a ground plane. The clearance region is shaped such that a portion of the radiating element in which an antenna feed is disposed is proximate the ground plane. The antenna can also be provided having an elliptically shaped tuning region disposed within the radiating antenna element. The antenna is suitable for use in single-ended or differential ultra wide band (UWB) transmitting and/or receiving systems.

24 Claims, 9 Drawing Sheets

DIFFERENTIAL AND SINGLE ENDED ELLIPTICAL ANTENNAS

CROSS REFERENCE TO RELATED APPLICATIONS

This application claims the benefit under 35 U.S.C. §119 of U.S. Provisional Application No. 60/582,099, filed Jun. 22, 2004.

STATEMENT REGARDING FEDERALLY SPONSORED RESEARCH

This invention was made with government support under Contract No. ANI-0335256 awarded by the National Science Foundation (NSF). The government has certain rights in the invention.

FIELD OF THE INVENTION

This invention relates generally to radio frequency (RF) transmitting and receiving systems and more particularly to an antenna element suitable for use in ultra wideband (UWB) radio applications.

BACKGROUND OF THE INVENTION

As is known in the art, pulsed Ultra Wideband (UWB) radio applications utilize radio or wireless devices that use relatively narrow pulse signals (i.e. pulse signals having pulse widths on the order of a few nanoseconds or less) for sensing and communication. Successful transmission and reception of UWB pulses entails minimization of ringing, spreading and distortion of the pulse. This requires a system having components which are impedance matched and which have near constant group delay (i.e. linear ungrouped phase) throughout the entire frequency range of operation.

SUMMARY OF THE INVENTION

In accordance with the present invention, a single-ended elliptical antenna (SEA) for use in ultra wide band (UWB) transmitting and/or single-ended receiving systems includes a radiating antenna element having an elliptical shape disposed on a first surface of a substrate. A dielectric clearance region also having an elliptical shape is disposed about the radiating antenna element to space the radiating antenna element from a ground plane. With this particular arrangement, an antenna suitable for use with UWB transmitters and/or single-ended receivers is provided. By providing the elliptical antenna as a printed circuit antenna disposed on a substrate with a clearance region, an ultra thin, low profile, single-ended elliptical antenna (SEA) having a relatively wide bandwidth characteristic is provided. In one embodiment, the clearance region is provided having an elliptical shape with a major axis of the clearance region aligned with a major axis of the radiating antenna element. Changing the shape (e.g. length of the major and/or minor axes) of the clearance region can change the antenna loading, bandwidth and frequency characteristics of the antenna. The clearance region is shaped such that a portion of the radiating element in which an antenna feed is disposed is proximate the ground plane. The clearance region separates or spaces the radiating element from the ground plane while still allowing the radiating element, and in particular a feed region of the radiating element to be proximate the ground plane. The clearance region thus provides the antenna having a relatively wide bandwidth characteristic. In one embodiment, the clearance region can be provided having a truncated elliptical shape. If a UWB transmitter and/or receiver is provided as an integrated circuit (IC) the IC can also be disposed on the ground plane of the same substrate as the planar elliptical antenna and the antenna and the IC can be coupled to provide an ultra thin, low profile, transmitting and/or receiving system. The antenna can also be provided having an elliptically shaped tuning region disposed within the radiating antenna element. The tuning region provides a means for impedance matching the antenna to a load.

In accordance with a further aspect of the present invention, a single-ended elliptical antenna (SEA) for use in ultra wide band (UWB) transmitting and/or single-ended receiving systems includes a radiating antenna element having an elliptical shape disposed on a first surface of a substrate. A dielectric tuning structure having an elliptical shape is disposed within the radiating antenna element with a major axis of the dielectric tuning structure disposed at a right angle to a major axis of the radiating antenna element. With this particular arrangement, an antenna suitable for use with UWB transmitters and/or single ended receivers is provided. By providing the elliptical antenna as a printed circuit antenna disposed on a substrate with a tuning structure, an ultra thin, low profile, single-ended elliptical antenna (SEA) is provided. Changing the shape (e.g. length of the major and or minor axis) of the dielectric tuning structure within the elliptical radiator changes the antenna loading and bandwidth characteristics of the antenna. If the UWB transmitter and/or receiver are provided as an integrated circuit (IC) the IC can also be disposed on the same substrate as the planar elliptical antenna and the antenna and IC can be easily integrated. The antenna can also be provided having an elliptically shaped clearance region disposed around the radiating antenna element. The clearance region provides a means for frequency tuning the antenna and also is shaped such that a portion of the radiating element in which the feed is disposed is proximate the ground plane. The clearance region also provides the antenna having a relatively wide bandwidth characteristic. In one embodiment, the clearance region can be provided having a truncated elliptical shape.

In accordance with a still further aspect of the present invention, a differential elliptical antenna (DEA) for use in UWB IC receivers includes a first radiating antenna element having an elliptical shape disposed on a first surface of a substrate. The first radiating antenna element has a major axis and a minor axis and a clearance region is disposed about the first radiating antenna element to space the radiating element from a grand plane which is also disposed on the first surface of the substrate. The differential elliptical antenna further includes a second radiating antenna element having an elliptical shape disposed on the first surface of the substrate and spaced a predetermined distance from the first radiating antenna element. The second radiating antenna element has a major axis aligned with a major axis of the first radiating antenna element. A clearance region is also disposed about the second radiating antenna element. With this particular arrangement, a differential elliptical antenna system suitable for use in UWB transmitters and/or differential receivers is provided. The UWB transmitter and/or differential receiver may be provided as an IC and disposed on the substrate and coupled to the first and second radiating antenna elements and a ground plane via any appropriate connection technique. By providing the elliptical antenna as a printed circuit antenna disposed on a substrate, an ultra thin, low profile, differential elliptical antenna (DEA) suitable for use with UWB differential receivers is provided.

The differential capability eases the design complexity of an RF front-end and the incorporation of a ground plane enables conformability with electronic UWB devices. Such a system is appropriate for use in UWB communication systems operating in the 3.1 to 10.6 GHz frequency range. In one embodiment, the first and second clearance regions are provided having an elliptical shape with a major axis of the each of the clearance regions aligned with respective ones of the major axis of the first and second radiating antenna elements. The clearance regions may be provided having a truncated elliptical shape. The first and second radiating elements can also have one or more tuning structures disposed therein. The tuning structure is provided having an elliptical shape with a major axis of the tuning structure disposed at a right angle to the major axis of the radiating antenna element.

In accordance with yet a further aspect of the present invention, a differential elliptical antenna (DEA) for use in UWB IC receivers includes a first radiating antenna element having an elliptical shape disposed on a first surface of a substrate. The first radiating antenna element has a major axis and a minor axis and a dielectric tuning structure is disposed in the first radiating antenna element. The tuning structure is provided having an elliptical shape with a major axis of the tuning structure disposed at a right angle to the major axis of the radiating antenna element. The differential elliptical antenna further includes a second radiating antenna element having an elliptical shape disposed on a first surface of a substrate spaced a predetermined distance from the first radiating antenna element. The second radiating antenna element has a major axis aligned with a major axis of the first radiating antenna element. A dielectric tuning structure is disposed in the second radiating antenna element. The tuning structure is provided having an elliptical shape with a major axis of the tuning structure disposed at a right angle to the major axis of the radiating antenna element. With this particular arrangement, a differential elliptical antenna system suitable for use in UWB transmitters and/or single ended receivers is provided. The UWB transmitter and/or single ended receiver may be disposed on the substrate and coupled to the antenna system and a ground plane via any appropriate connection technique. By providing the elliptical antenna as a printed circuit antenna disposed on a substrate, an ultra thin, low profile, single-ended elliptical antenna (DEA) for use in UWB IC receivers is provided. The differential capability eases the design complexity of the RF front-end and the incorporation of a ground plane enables conformability with electronic UWB devices. Such a system is appropriate for use in UWB communication systems operating in the 3.1 to 10.6 GHz frequency range.

In accordance with a still further aspect of the present invention, an elliptical antenna includes a radiating antenna element having an elliptical shape disposed on a first surface of a substrate. The radiating antenna element has a major axis and a minor axis. A truncated clearance region is disposed about the antenna. With this particular arrangement, an antenna having a compact topology is provided. By providing the clearance region having a truncated shape, the operating frequency of the antenna is reduced. Thus, the radiating antenna element can be provided having a size typically selected for operation at a frequency which is higher than the desired frequency of operation. In one embodiment, the clearance region is provided having a truncated elliptical shape. An elliptical tuning structure may or may not be included within the boundaries of the radiating antenna element.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Figure 1:
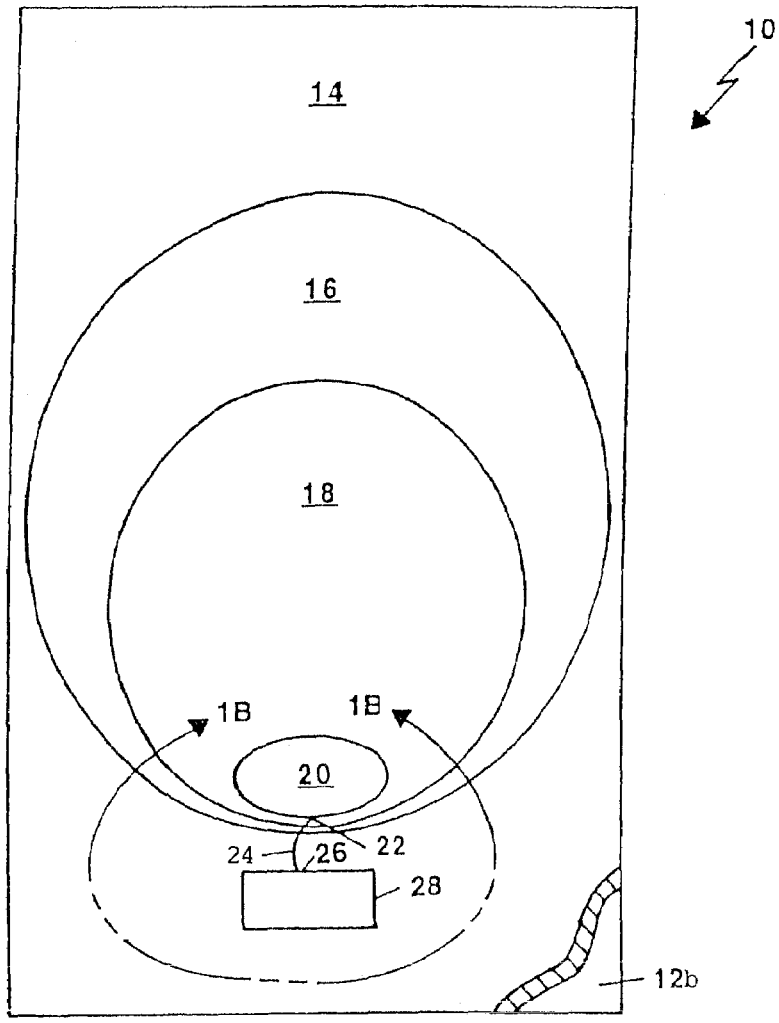
FIG. 1 is a top view of a single-ended elliptical antenna (SEA)
Figure 1A:
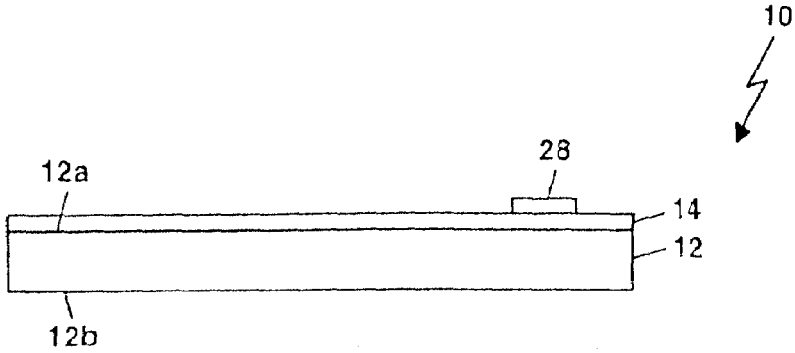
FIG. 1A is a side view of the single-ended elliptical antenna of FIG. 1
Figure 1B:
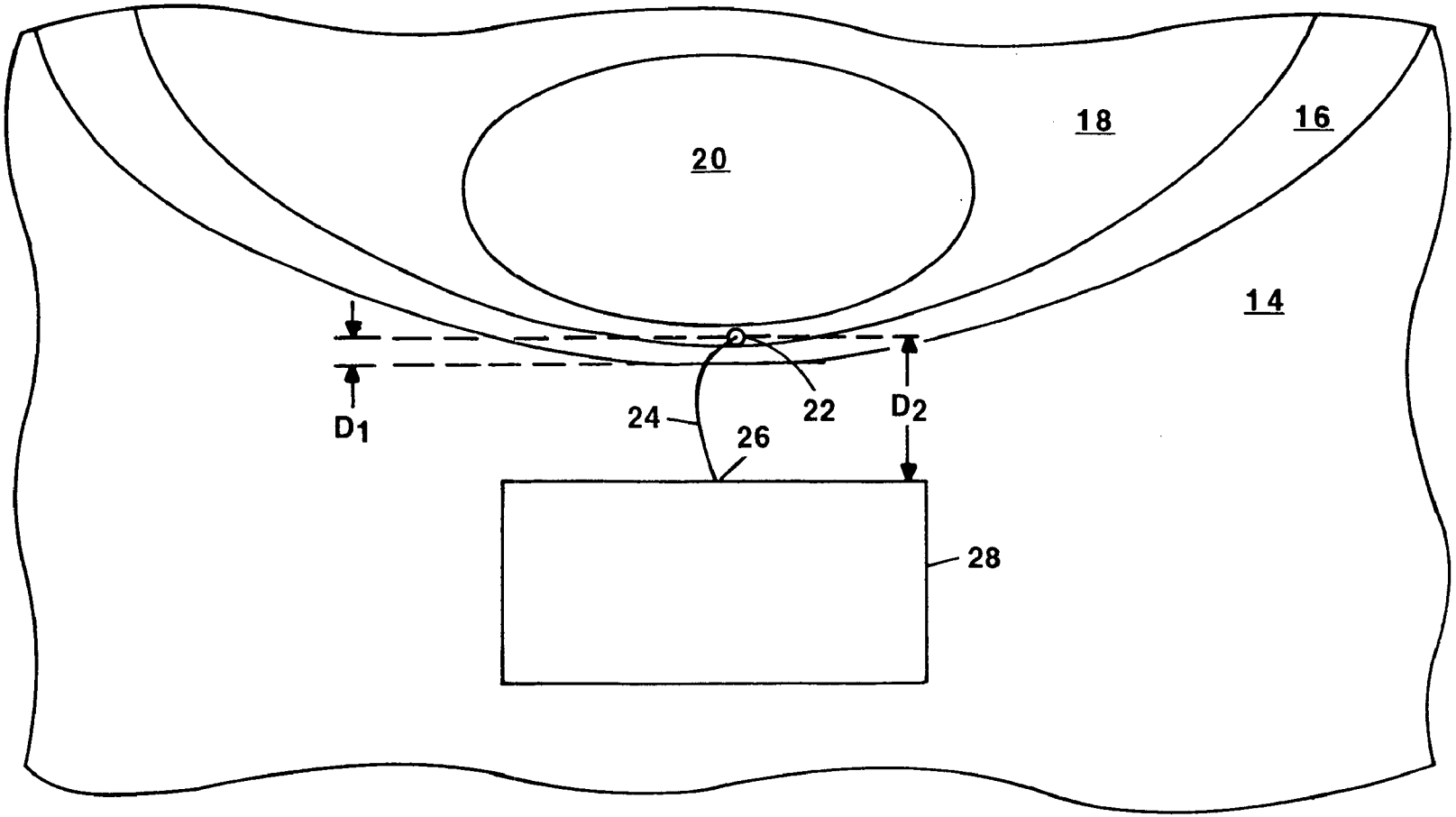
FIG. 1B is an expanded view of the SEA of FIG. 1 taken along lines 1B—1B taken along lines 1B—1B in FIG. 1.

Referring now to FIGS. 1–1B in which like elements are provided having like reference designations throughout the several views, a single-ended elliptical antenna (SEA) system 10 includes a substrate 12 having first and second opposing surfaces 12*a*, 12*b* (FIG. 1*a*). The substrate 12 is provided from any suitable dielectric material such as fiberglass, PTFE, or the like having a suitable relative dielectric constant (er). Disposed over the first surface 12*a* of the substrate 12 is a conductive material which provides a ground plane 14. The conductive material may be provided from copper or any other suitable conductive material. To promote clarity and understanding of FIGS. 1 and 1A, in the lower right corner of FIG. 1, portions of the ground plane 14 have been removed to reveal the underlying second surface 12*b* of the substrate 12.

The conductive material is patterned or otherwise provided on the first surface of the substrate to define a tapered clearance region 16 (i.e. a region without conductive material disposed therein) having an elliptical shape. The conductive material is disposed on the first surface of the substrate to define a radiating antenna element 18, also having an elliptical shape. The axial ratio of regions 16, 18 (i.e. the respective ratios of the minor to major axis in each of the regions 16, 18) is selected to be relatively close. With this arrangement, the antenna can provide nearly omnidirectional radiation patterns.

Disposed in the radiating antenna element 18 is a tuning structure 20. The tuning structure 20 is also provided having an elliptical shape with a major axis of the ellipse disposed in a direction which is perpendicular to the major axis of the radiating antenna element 18. The frequency tuning structure 20 is provided to tune the antenna element.

An antenna feed point 22 is coupled via a signal path 24 to a connection point 26 of an integrated circuit (IC) 28. The antenna element feed 22 is preferably provided at a point along the major axis of the element 18. RF signals can be coupled between the IC 28 and the feed point 22 of the radiating antenna element 18. The IC 28 may be provided as a receiver or transmitter depending upon the particular application. In one embodiment, MMCX connectors having MMCX to SMA adapters can be coupled to the feed 22. Other types of connectors can, of course, also be used.

The ellipticity ratio of the structure 20 can be adjusted (e.g. increased or decreased) to provide a desired antenna impedance match and may also result in an increase in antenna directivity. Also, better impedance matching for a particular bandwidth may be achieved by placing the radiating antenna element 18 relatively close to the feed point 22. In one particular embodiment, a preferred match was achieved at a distance of approximately 0.010" as measured from the bottom center edge of the radiator proximate the feed point. An edge of the radiating antenna element 18 was spaced about 0.005" from the ground plane 14 at the unloaded SEA feed 22, and spaced about 0.010" from the loaded SEA feed 22.

The single-ended antenna system 10 may find use, for example, in Ultra Wideband 3.1–10.6 GHz communication systems. In one particular embodiment, the antenna system 10 was provided with the substrate 12 having a relative dielectric constant er of about 3.36, a tan δ of about 0.0037, and a thickness of about 0.004 inch (4.0 mils). The conductive layer 14 (most clearly seen in FIG. 1) disposed over the substrate 12 was provided as 1 oz rolled copper having a thickness of about 1.5 mils. It should be appreciated that substrates having a different relative dielectric constant, loss and thickness values may also be used depending upon the desired application. Similarly the conductive layer may be provided from any suitable conductor having a suitable thickness.

Regions 16 and 20 can be formed using a subtractive process (e.g. by applying either a positive or negative mask to a conductor disposed over the substrate surface and using an etchant to remove desired portions of the conductor as is generally known to provide the regions 14, 16, 18 and 20). It should be appreciated, however, that in some embodiments it may be desirable to use an additive process (e.g. by beginning with a substrate having no conductor provided thereon and depositing the conductor on the substrate to define the desired conductive and nonconductive regions 14, 16, 18, 20). In one particular embodiment, the radiating antenna element 18 had a minor axis radius (x-radius) of about 0.360" and a major axis radius (y-radius) of about 0.405". The clearance region 16 was provided having a minor axis radius (x-radius) of about 0.500" and a major axis radius (y-radius) of about 0.575". The tuning structure 20 placed in the loaded SEA had a major axis radius (x-radius) of about of 0.130" and a minor axis radius (y-radius) of about 0.080" and the structure was placed about 0.010" from the feed point 22.

While the tuning structure 20 is shown having a particular orientation with respect to the antenna element 18, it should be appreciated that other orientations are possible with this invention. The tuning structure 20 can be disposed in any direction that provides a desired tuning effect on radiating antenna element 18. Furthermore, by varying the spacing of the tuning structure 20 from the feed point 22, varying impedances can be presented to an antenna feed circuit coupled to the feed point 22. The spacing of the tuning structure 20 from the feed point 22 can be provided as any distance that provides the antenna having a desired antenna characteristic. For example, the dimensions and spacing of the structure 20 may be selected to provide the antenna having a desired antenna radiation pattern, a desired antenna impedance, etc. . .

While a single tuning structure 20 is shown to be associated with the radiating antenna element 18, it should be appreciated that in some embodiments it may be desirable or necessary to utilize two or more structures 20 appropriately disposed in the element 18.

It should also be understood that, in some applications, antenna 10 can correspond to an antenna sub-assembly, or sub-array, and that a plurality of such antenna sub-assemblies can be disposed to provide an antenna.

Referring now to FIG. 1B, in the region of the feed 22, the radiating element 18 is spaced from the ground plane 14 by a predetermined distance D1 and the IC 28 is disposed on the ground plane and spaced from the feed 22 by a distance D2. It is preferable to make the distance D2 as short as possible such that the signal path 24 between the feed 22 and the IC attachment point 26 is as short as possible. It should be appreciated that the IC 28 is both physically coupled to the ground plane (e.g. by bonding) and electrically coupled to the ground plane (e.g. i.e. the electrical ground of the IC is coupled to the ground plane 14). It should also be appreciate that the IC 28 can be disposed on the surface of the substrate (e.g. over the ground plane 14) or the IC may be embedded in the substrate (e.g. disposed in an opening or hole provided in the ground plane).

Figure 2:
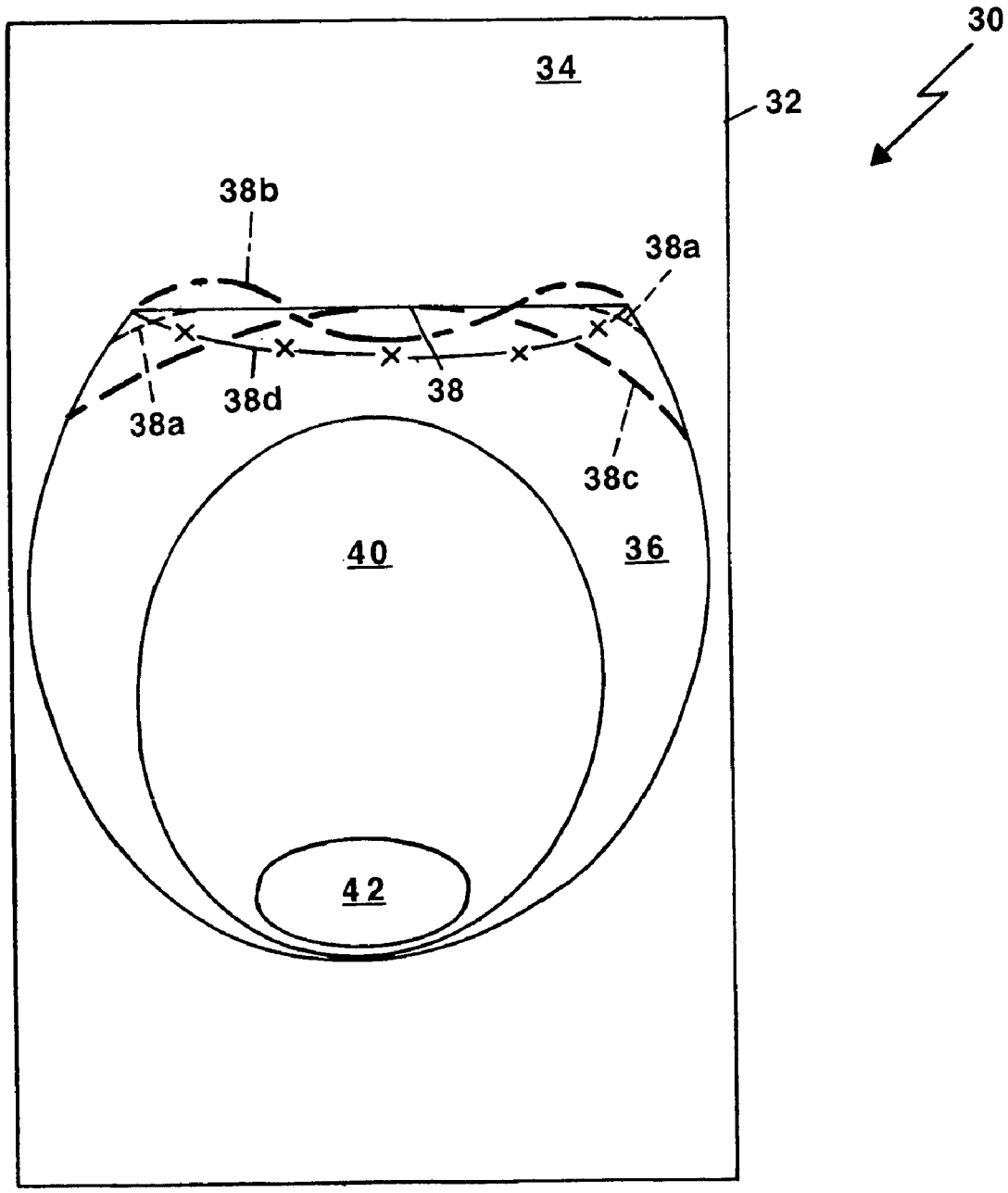
FIG. 2 is a top view of an elliptical antenna having a truncated clearance section.

Referring now to FIG. 2, an antenna element 30 is provided from a substrate 32 having a conductor disposed thereover. First portions of the conductor form a ground plane 34 and second portions of the conductor from a radiating antenna element region 40 having an elliptical shape. The radiating antenna element 40 is similar to the radiating antenna element 18 described above in conjunction with FIG. 1. The conductor is absent from a region 36 which corresponds to a clearance region 36.

The clearance region 36 is provided having a generally elliptical shape with one edge 38 of the region 36 being truncated. Truncating a portion of the clearance region 36 reduces the operating frequency of the antenna 30. This truncated ellipse geometry results in the antenna element 40 having a reduced sized for a given operating frequency.

For example, if the desired operating frequency of the antenna were 3.1 GHz, then the radiating element would be designed for operation at a frequency above 3.1 GHz (e.g. 3.6 GHz). By truncating the ellipse of the clearance region, the operational frequency of the element can be lowered by a predetermined amount related to the size of the truncation. The larger the truncated section, the more the frequency is lowered. Thus, by truncating an appropriate amount from the clearance region the operating frequency of the antenna can be lowered from 3.6 GHz to 3.1 GHz. Since an antenna element designed for operation at 3.6 GHz is smaller than an antenna designed for operation at 3.1 GHz, then an antenna having a reduced size is provided.

The particular location at which the clearance section is truncated (i.e. the amount to truncate from the clearance region) is selected to provide the antenna having desired antenna characteristics in accordance with the needs of each particular application. In some applications the specific location at which to truncate ellipse 36 is selected empirically. It is recognized, however, that the smoothly tapered portion of the clearance section 36 proximate the feed impacts at least the impedance characteristics of the antenna. The larger the truncation (e.g. the closer truncation edge 38 is to the radiating element 40) the greater the reduction in frequency. The truncation also results in a reduction in the bandwidth characteristic of the antenna.

It should be appreciated that the edge 38 may be provided having one of a variety of different shapes including but not limited to rounded shape (as indicated by dashed lines marked by reference number 38*a*), a partial sinusoidal shape (as indicated by dashed lines marked by reference number 38*b*), a convex shape (as indicated by dashed lines marked by reference numbers 38*c*), a concave shape (as indicated by dashed lines marked by reference numbers 38*d*), a saw-tooth shape (not shown) a triangular shape (not shown), or even an irregular shape.

Disposed in the radiating antenna element region 40 is a tuning structure 42 which may be similar to the tuning structure 20 described above in conjunction with FIGS. 1–1B. The tuning structure 42 is provided having an elliptical shape with a major axis of the ellipse perpendicular to the major axis of the radiating antenna element region 40. The tuning structure 42 is provided to tune the antenna element.

The antenna 30 is also provided having an antenna feed point (not shown in FIG. 2) which is similar to the feed 22 described above in conjunction with FIGS. 1–1B. It should be understood that a truncated clearance region 36 may be used with either a single-ended system or with a differential system as will be described below in conjunction with FIGS. 3 and 3A.

Figure 3:
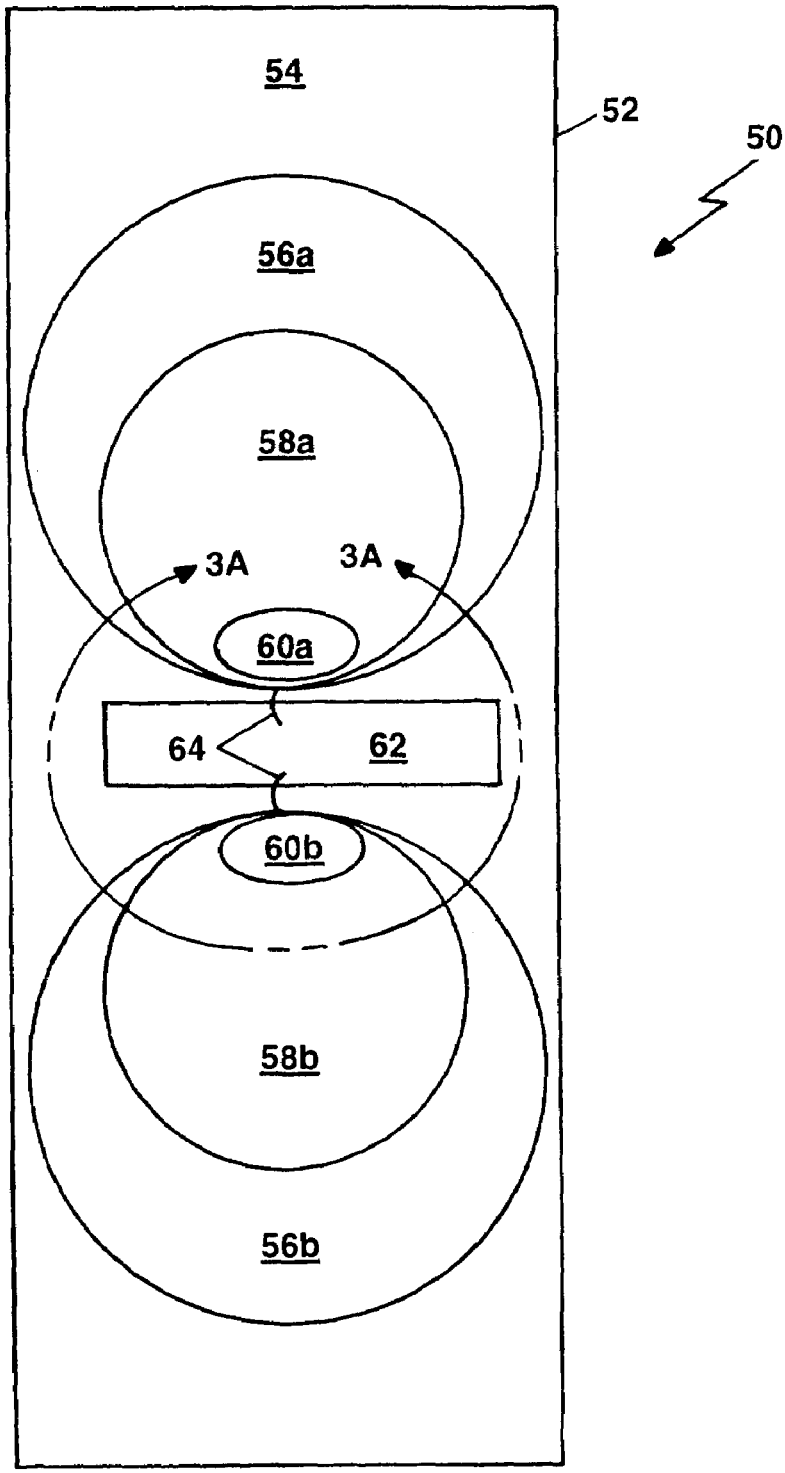
FIG. 3 is a top view of a differential elliptical antenna (DEA)
Figure 3A:
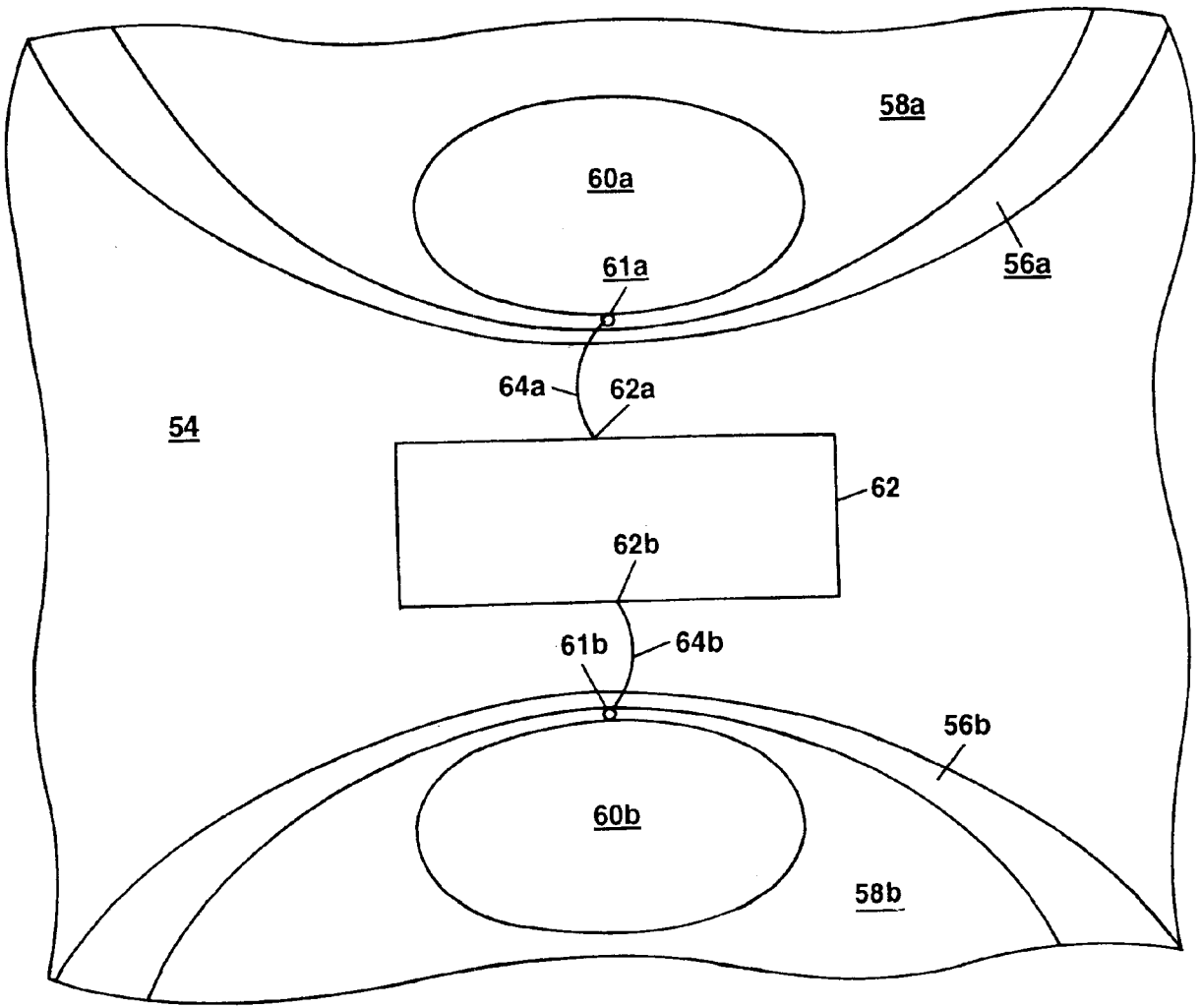
FIG. 3A is an expanded view of the DEA of FIG. 3 taken along lines 3A—3A in FIG. 3.

Referring now to FIGS. 3 and 3A in which like elements are provided having like reference designations, a differential elliptical antenna (DEA) system 50 includes a substrate having a conductor disposed thereover to define a ground plane 54 and a pair of radiating antenna elements 58*a*, 58*b*. Dielectric regions 56*a*, 56*b* (i.e. regions in which no conductor is disposed on the substrate) correspond to clearance regions while dielectric regions 60*a*, 60*b* correspond to tuning regions. Thus, the conductive material is patterned or otherwise disposed to define the ground plane 54, clearance regions 56*a*, 56*b*, radiating antenna element regions 58*a*, 58*b* and tuning regions 60*a*, 60*b*.

Referring briefly to FIG. 3A, the radiating antenna elements 58*a*, 58*b* and feed points 61*a*, 61*b* are symmetrically disposed on the substrate 52 and about an integrated circuit 62. The IC 62 has first and second terminals 62*a*, 62*b* coupled to the respective antenna element feeds 61*a*, 61*b*. The radiating elements 58*a*, 58*b* correspond to complementary poles (e.g. positive and negative poles) in the differential system.

In one embodiment, each of the feed points 61*a*, 61*b* were coupled to MMCX connectors having an MMCX-to-SMA adapter coupled thereto It was found that changing the ellipticity ratio of the tuning structures 60*a*, 60*b* (e.g. either increasing or decreasing the ellipticity ratio of the tuning structures 60*a*, 60*b*) allowed a favorable impedance match with an increase in directivity to be achieved. It is also noted that preferred impedance matching for a given bandwidth can generally be achieved by closer placement of the radiating ellipse to the feed point.

In one embodiment, the radiating antenna elements are provided having a minor axis radius (x-radius) of about 0.360" and a major axis radius (y-radius) of about 0.405" and the total clearance ellipse was provided having a minor axis radius (x-radius) of about 0.500" and a major axis radius (y-radius) of about 0.575". The tuning structures 60*a*, 60*d* placed in the loaded DEA had a major axis radius (x-radius) of about of 0.130" and a minor axis radius (y-radius) of about 0.080" and were placed about 0.005" from their respective feed points 61*a*, 61*b*. In this case, a favorable impedance match was achieved by placing the radiating antenna elements 58*a*, 58*b* about 0.010" from the loaded DEA feeds 61*a*, 61*b*.

As can be clearly seen in FIG. 3A, the antenna feed regions 61*a*, 61*b* (which in a differential system correspond to positive and negative feed regions) have respective ones of bond wires 64*a*, 64*b* coupled thereto. The bond wires 64*a*, 64*b* couple the antenna feed points 61*a*, 61*b* to appropriate contact regions 62*a*, 62*b* of the IC 62. The IC contact regions may 62*a*, 62*b* may correspond to pins, pad regions or any other appropriate connection point on the IC 62.

The antenna can be fed with coaxial cables, SMA connectors, MMCX to SMA connectors, or by line feeds from the IC 62. It should be appreciated that the IC is grounded to the common ground 54 with a positive wire (e.g. 62*a*) and a negative wire (e.g. 62*b*) attached to the respective ones of the positive and negative antenna feeds.

The distance from positive to negative is preferably kept relatively short. In one particular embodiment, the bond wires 64*a*, 64*b* are provided having a length typically of about 6 mm. This also accommodates the relatively small size of the IC 62. Keeping relatively short connections helps reduce reflections and dispersion of pulse signals provided to the antenna.

Figure 4:
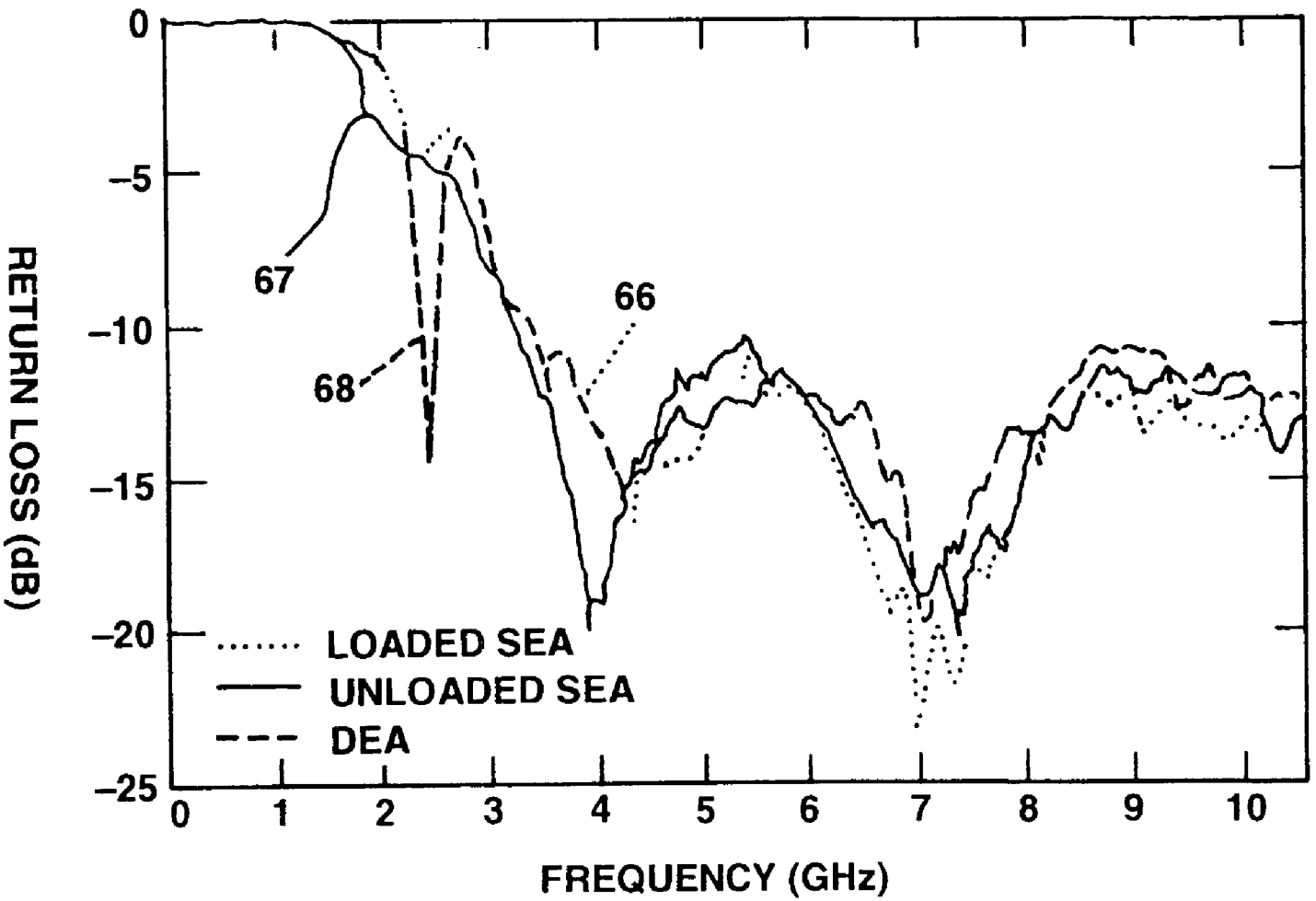
FIG. 4 is a plot of return loss vs. frequency for a single-ended elliptical antenna and a differential elliptical antenna.

Referring now to FIG. 4, a plot of return loss vs. frequency includes a first 66 corresponding to the return loss for a loaded SEA antenna, a second curve 67 corresponding to the return loss for an unloaded SEA antenna and a third curve 68 corresponding to the return loss for a DEA antenna. The SEA and DEA antennas were of the types and dimensions described above.

It should be appreciated that the lower end theoretical frequency (VSWR$\leqq$2) for a conventional CDM of this size is 3.15 GHz. Simulations of a CDM of these dimensions were in agreement with theory (achieving a lower end frequency of 3.13 GHz).

As can be seen in FIG. 4, the measured lower end frequencies of the antennas described herein above in conjunction with FIGS. 1 and 3 were 3.09 GHz for the loaded SEA, and 3.2 GHz for the unloaded SEA and DEA. The loaded SEA seems to have a slight advantage in achieving better impedance matching throughout the UWB frequency band, especially affecting the second mode of resonance at 7.2 GHz, as well as achieving a slightly lower $f_0$. This suggests that size reduction can be employed with further investigation of antenna loading techniques. The DEA would be expected to achieve similar characteristics as the loaded SEA; however, the slot load placement is twice the distance from the feed in the DEA than the SEA, and the surrounding metal area also alters its frequency characteristic. It should be appreciated that slight differences in the manufacture of the antennas (including the feeds) could contribute to some inconsistency in the data for the loaded SEA and DEA.

One notable characteristic of the DEA is that it had a resonant point at 2.46 GHz, although not optimally tuned, which suggests that dual mode 802.11b and UWB antennas are achievable. Two significant features of the antennas described herein are the achievement of wide bandwidth throughout the UWB frequency range and that the antenna loading increases resonance effects and could facilitate size reduction.

Figure 5:
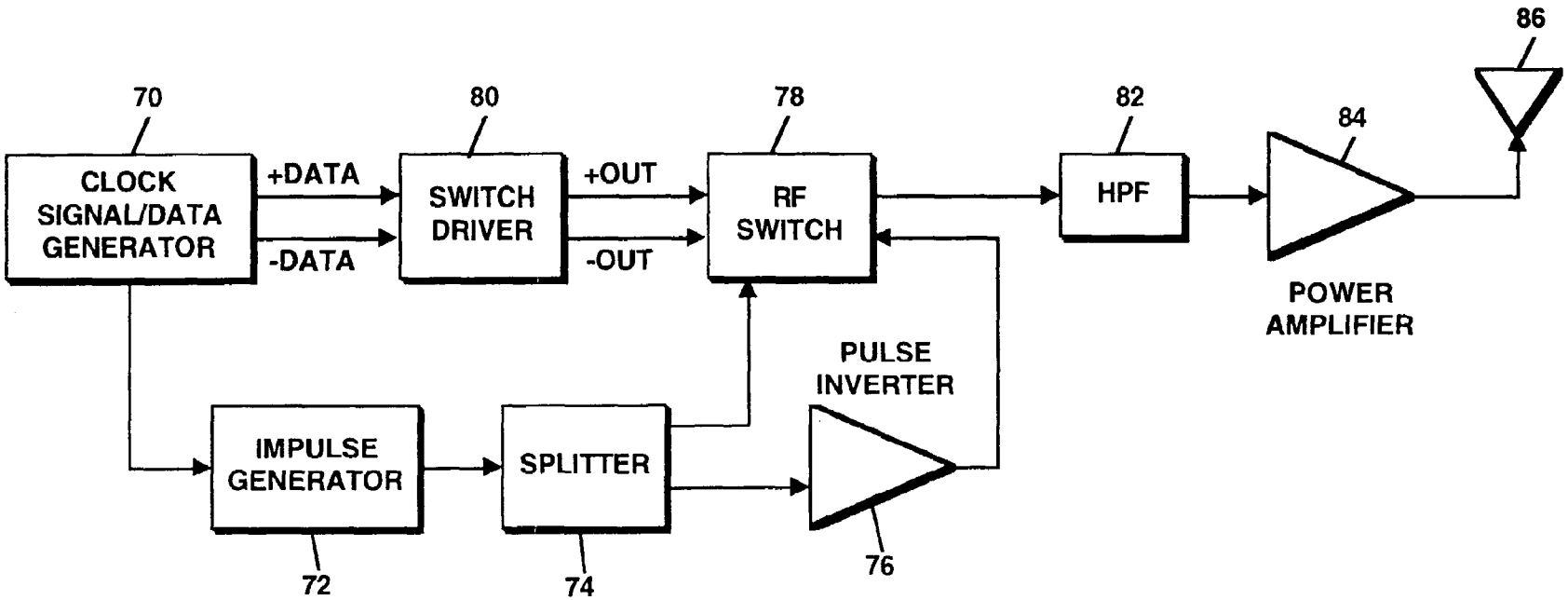
FIG. 5 is a block diagram of a transmit system.

Referring now to FIG. 5, a transmitter system used to test the UWB antenna systems described above in conjunction with FIGS. 1 and 3 includes a clock and data generator 70, which provides a 100 MHz clock signal and data synchronized with the clock signal. This corresponds to a pulse signal having a pulse repetition rate (prf) of 10 ns. The clock signal is fed to an impulse generator 72, which generates sub-nanosecond pulse signals. The signal provided by the impulse generator 72 is split into positive and negative pulse signals via a power splitter 74 and pulse inverter 76. The positive and negative pulse signals are then fed to an RF switch 78, driven by a switch driver circuit 80 that provides a negative (e.g. −5V) drive voltage. Thus, the RF switch 78 produces positive and negative pulses at its output depending upon the data that the RF switch driver 80 receives from the data generator 70. The switch output is then filtered through a high pass filter 82. For operation in the UWB frequency range, the filter 82 is provided having a 3 GHz cutoff frequency. The signal is then amplified via a power amplifier 84, and then emitted through an antenna which in one embodiment is provided as a horn antenna having a bandwidth in the 1–18 GHz frequency range.

Figure 6:
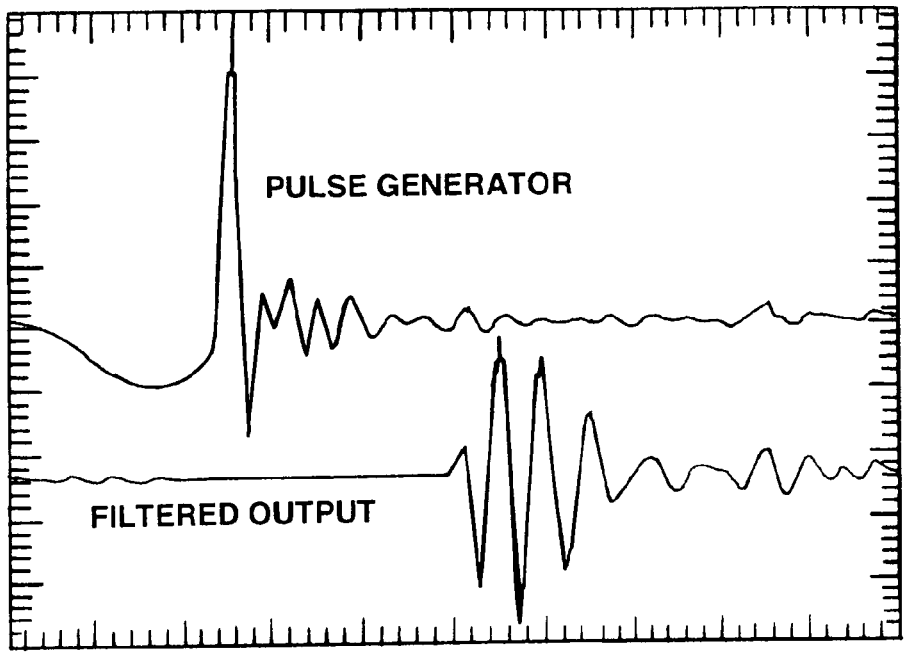
FIG. 6 is a plot of a Impulse generator output signal and filtered pulse output signal.

Referring now to FIG. 6, plots of signal output from the impulse generator vs. time and the filtered UWB pulse vs. time is shown. Both signals were measured on a digitizing oscilloscope at 500 ps/div and 30 mv/div. The pulse output and filtered output required 20 dB and 10 dB of attenuation, respectively, to account for the sensitivity of the oscilloscope. It should be noted that while the pulse output and filtered pulse are not ideal and both show some level of ringing at the tail end, the system is capable of receiving a pulse that is transmitted with a minimal level of pulse shape distortion.

Figure 7:
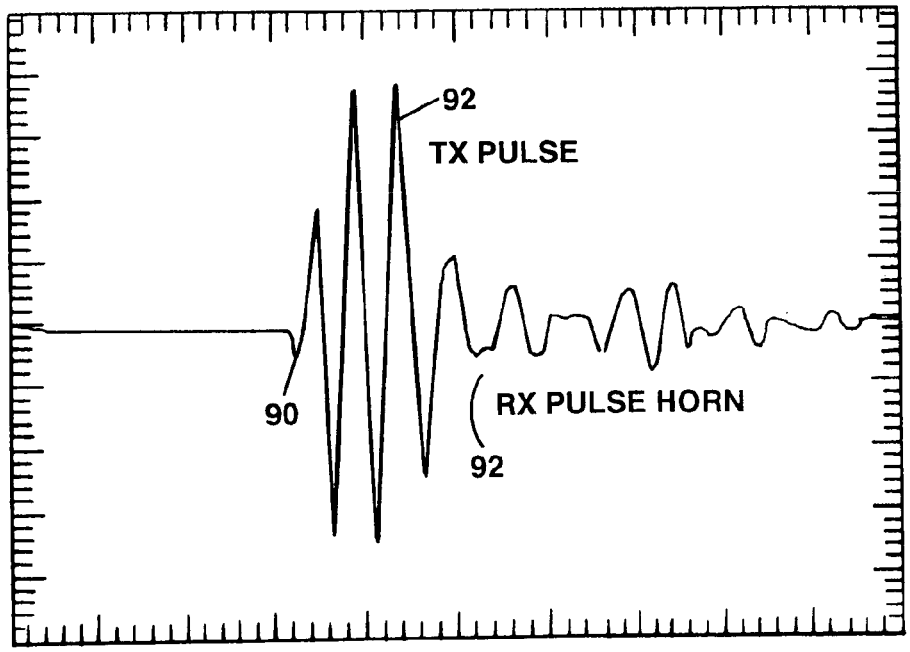
FIG. 7 is a plot of a transmitted pulse signal superimposed over a received horn pulse signal.
Figure 8:
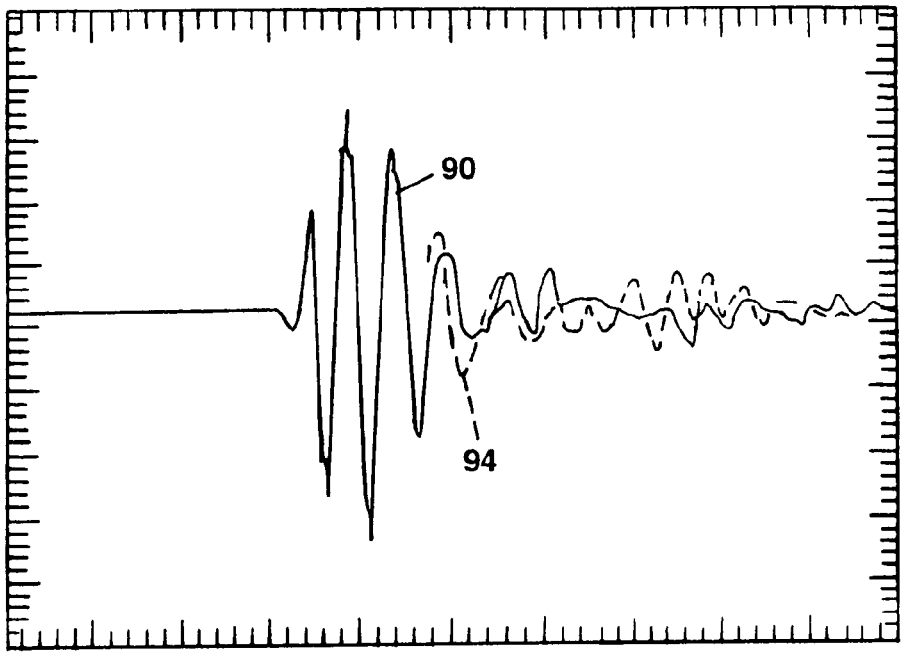
FIG. 8 is a plot of a transmitted pulse signal superimposed over a received pulse from a loaded single-ended antenna.

Referring now to FIGS. 7 and 8, plots of a transmitted pulse 90 from the horn antenna 86 (FIG. 5) superimposed on the received pulse from the horn 92 (FIG. 7) and loaded SEA 94 (FIG. 8), respectively are shown. Pulse reception measurement was similar for the unloaded SEA and the DEA. This test setup was conducted in a typical multipath lab environment, and the reception distance was approximately 1.5 meters. The transmitted pulse was measured directly at the amplifier terminals with a 30 dB attenuator. Each measurement was taken on a timescale of 500 ps/div.

Figure 9:
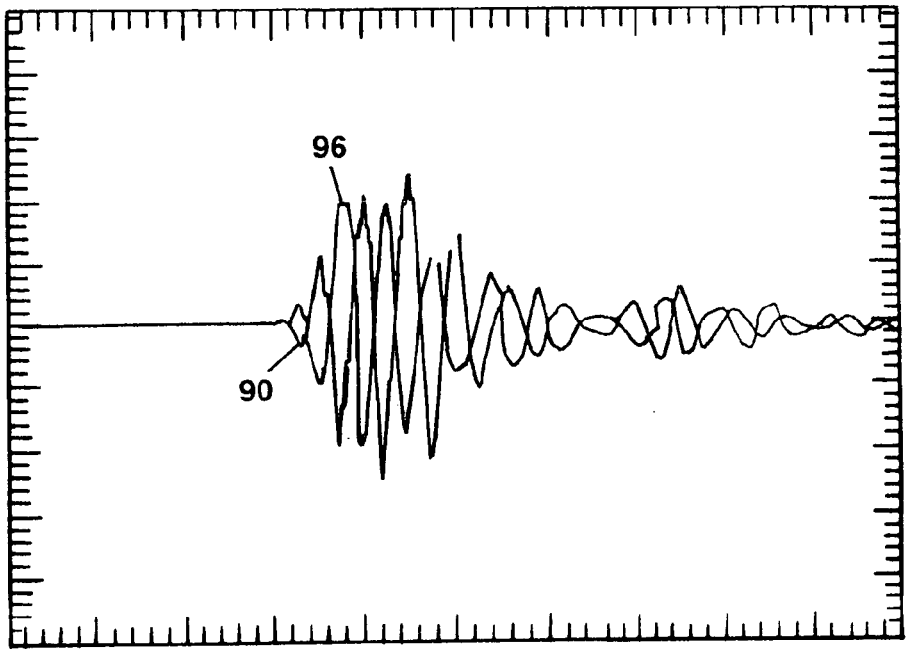
FIG. 9 is a plot of a received pulse signals from positive and negative terminals of a differential elliptical antenna.

FIG. 7 shows measurements taken at 20 mV/div. The measurements of the received pulses of FIGS. 8 and 9 are taken directly at the antenna terminals at 10 mV/div. By the theory of reciprocity, it can be inferred that each antenna transmits the same way it receives.

The differential antenna was optimized for an RF front-end, as the common ground spacing between the positive and negative terminals allow for the IC to be housed. At relatively high frequencies, substrate noise can be a substantial problem which makes a differential input at the RF front-end an optimal solution such that common mode noise can be rejected.

FIG. 9 illustrates the received pulses 96, 98 from the positive and negative terminals of the DEA, indicating that the received pulses are inverses of each other.

Each plot shows clearly that very little pulse distortion can be observed from the transmitted pulse to the received pulse. There is very little qualitative difference that can be observed in pulse distortion for the horn vs. the elliptical antennas.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. An antenna comprising:

a substrate having first and second opposing surfaces;

a first conductor disposed on the first surface of said substrate, said first conductor corresponding to a ground plane of the antenna;

a second conductor disposed on the first surface of said substrate, said second conductor having an outer perimeter with an elliptical shape such that the second conductor corresponds to an antenna element having an elliptical shape;

a first dielectric region disposed about the perimeter of said antenna element such that the first dielectric region electrically isolates the antenna element from said ground plane; and a second dielectric region provided within the outer perimeter of said second conductor, such that said second dielectric region corresponds to a tuning structure located within said antenna element.

2. The antenna of claim 1, wherein:

said first dielectric region is provided having an elliptical shape and a major axis of said first dielectric region is aligned with a major axis of the antenna and said second dielectric region is provided having an elliptical shape and a major axis of said second dielectric region is aligned with a maior axis of the radiating antenna element.

3. The antenna of claim 1 wherein:

the antenna element is provided as a feed; and the minor axis of the first dielectric region is offset from the minor axis of the antenna element such that a portion of the antenna element in which the feed is disposed is proximate the ground plane.

4. The antenna of claim 3, wherein said first dielectric region is provided having a truncated elliptical shape.

5. The antenna of claim 1, wherein said second dielectric region is provided having an elliptical shape and a major axis of said tuning structure is disposed at a right angle to the major axis of said radiating antenna element.

6. The antenna of claim 5 further comprising an integrated circuit coupled to a feed point of said radiating element.

7. The antenna of claim 1 wherein the radiating antenna element is a first radiating antenna element and said dielectric clearance region is a first dielectric clearance region and the antenna further comprises:

a second radiating antenna element having an elliptical shape and disposed on the first surface of said substrate proximate said first radiating antenna element with a major axis of said second radiating antenna element aligned with the major axis of said first radiating antenna element;

a second dielectric clearance region having an elliptical shape disposed about the second radiating antenna element to space the second radiating antenna element from said ground.

8. The antenna of claim 7, wherein said second clearance region is provided having an elliptical shape and a major axis of said second clearance region is aligned with the major axis of said second radiating antenna element.

9. The antenna of claim 7 wherein:

said second radiating antenna element is provided having a feed; and the minor axis of said second clearance region is offset from the minor axis of said second radiating antenna element such that a portion of said radiating antenna element in which the feed is disposed is proximate the ground plane.

10. The antenna of claim 9, wherein the said second clearance region is provided having a truncated elliptical shape.

11. The antenna of claim 10, further comprising a second tuning structure coupled to said second radiating element.

12. The antenna of claim 11, wherein said second tuning structure is provided having an elliptical shape and a major axis of said second tuning structure is disposed at a right angle to the major axis of said second radiating antenna element.

13. The antenna of claim 12 wherein the feed of said second radiating antenna element is coupled to said integrated circuit.

14. A single-ended elliptical antenna (SEA) for use in ultra wide band (UWB) transmitting and/or single-ended receiving systems, the SEA comprising:

a substrate an antenna element having an elliptical shape disposed on a first surface of the substrate, said antenna element having a feed point;

a dielectric tuning structure having an elliptical shape disposed within the antenna element with a major axis of the dielectric tuning structure disposed at a right angle to a major axis of said antenna element; and a signal path coupled to the feed point of said antenna element.

15. The antenna of claim 14 further comprising:

a ground plane disposed on the first surface of said substrate;

a dielectric clearance region having an elliptical shape disposed about said antenna element to space said antenna element from said ground plane.

16. The antenna of claim 15, wherein said clearance region is provided having an elliptical shape and a major axis of the clearance region is aligned with a major axis of said antenna element.

17. The antenna of claim 16 wherein:

said radiating antenna element is provided having a feed; and the minor axis of said clearance region is offset from the minor axis of said radiating antenna element such that a portion of said antenna element in which the feed is disposed is proximate said ground plane.

18. The antenna of claim 17, wherein the clearance region is provided having a truncated elliptical shape.

19. A differential antenna (DEA) for use in an ultra wide band (UWB) system, the differential antenna comprising:

a substrate a first radiating antenna element having an elliptical shape disposed on a first surface of the substrate;

a second radiating antenna element having an elliptical shape disposed on a first surface of the substrate proximate said first radiating antenna element with a major axis of said second radiating antenna element aligned with a major axis of said first radiating antenna element;

a first dielectric tuning structure having an elliptical shape disposed within said first radiating antenna element with a major axis of said first dielectric tuning structure disposed at a right angle to a major axis of said first radiating antenna element; and a second dielectric tuning structure having an elliptical shape disposed within said second radiating antenna element with a major axis of said second dielectric tuning structure disposed at a right angle to a major axis of said second radiating antenna element.

20. The antenna of claim 19 further comprising:

a ground plane disposed on the first surface of said substrate a first dielectric clearance region having an elliptical shape disposed about said first radiating antenna element to space said first radiating antenna element from said ground plane; and a second dielectric clearance region having an elliptical shape disposed about said second radiating antenna element to space said second radiating antenna element from said ground plane.

21. The antenna of claim 20, wherein a major axis of each of said first and second clearance region is aligned with a respective one of the major axis of said first and second radiating antenna elements.

22. The antenna of claim 21 wherein:

each of said first and second radiating antenna elements is provided having a feed; and the minor axis of each of said first and second clearance regions is offset from the minor axis of each of said first and second radiating antenna elements such that a portion of said first and second radiating antenna elements in which the respective feeds are disposed are proximate said ground plane.

23. The antenna of claim 22, wherein the clearance region is provided having a truncated elliptical shape.

24. The antenna of claim 23, further comprising an integrated circuit coupled to each of said first and second feed circuits.

* * * * *

UNITED STATES PATENT AND TRADEMARK OFFICE

CERTIFICATE OF CORRECTION

PATENT NO. : 7,187,330 B2
APPLICATION NO. : 11/158905
DATED : March 6, 2007
INVENTOR(S) : Powell et al.

It is certified that error appears in the above-identified patent and that said Letters Patent is hereby corrected as shown below:

Column 2, line 4 delete “(IC) the IC” and replace with --(IC), the IC--.

Column 2, lines 26-27 delete “and or” and replace with --and/or--.

Column 2, lines 30-31 delete “(IC) the IC” and replace with --(IC), the IC--.

Column 3, line 8 delete “the each” and replace with --each--.

Column 4, line 11 delete “taken along lines 1B-1B”.

Column 4, line 22 delete “a Impulse” and replace with --an impulse--.

Column 4, line 29 delete “of a received pulse signals” and replace with --of received pulse signals--.

Column 5, line 55 delete “of about of 0.130”” and replace with --of about 0.130”--.

Column 6, line 24 delete “(e.g. i.e.” and replace with --(i.e.--.

Column 6, line 25 delete “appreciate” and replace with --appreciated--.

Column 6, line 35 delete “from a” and replace with --form a--.

Column 7, line 6 delete “to rounded shape” and replace with --to a rounded shape--.

Column 7, line 66 delete “of about of 0.130”” and replace with --of about 0.130”--.

Column 8, line 11 delete “may 62a, 62b may” and replace with --62a, 62b may--.

UNITED STATES PATENT AND TRADEMARK OFFICE

CERTIFICATE OF CORRECTION

PATENT NO. : 7,187,330 B2
APPLICATION NO. : 11/158905
DATED : March 6, 2007
INVENTOR(S) : Powell et al.

It is certified that error appears in the above-identified patent and that said Letters Patent is hereby corrected as shown below:

Column 8, line 27 delete “a first 66” and replace with --a first curve 66--.

Column 8, line 39 delete “herein above” and replace with --hereinabove--.

Signed and Sealed this

Eighteenth Day of March, 2008

JON W. DUDAS
*Director of the United States Patent and Trademark Office*